US006006631A

United States Patent [19]

Miner et al.

[11] Patent Number: 6,006,631

[45] Date of Patent: Dec. 28, 1999

[54] THROUGH-HOLE QUICK RELEASE ADAPTERS

[76] Inventors: Montie H. Miner, 2205 Robert, Granite, Ill. 62040; Gary Sausto, 1 Lake Side Cir., Lake St. Louis, Mo. 63367

[21] Appl. No.: 09/081,504

[22] Filed: May 20, 1998

[51] Int. Cl.[6] ..... B25B 13/16

[52] U.S. Cl. ..... 81/177.85; 81/60; 81/180.1

[58] Field of Search ..... 81/60–63.2, 177.2, 81/177.85, 180.1

[56] References Cited

U.S. PATENT DOCUMENTS

| | | | |
|---|---|---|---|
| 2,954,994 | 10/1960 | Beers | 287/119 |
| 3,208,318 | 9/1965 | Roberts | 81/177 |
| 3,393,587 | 7/1968 | Jolliff et al. | 81/63.2 |
| 3,532,013 | 10/1970 | Haznar | 81/62 |
| 3,713,356 | 1/1973 | Knudsen | 81/177.6 |
| 4,211,127 | 7/1980 | D'Oporto | 81/63 |
| 4,399,722 | 8/1983 | Sardo, Jr. | 81/60 |
| 4,762,033 | 8/1988 | Chow | 81/63 |
| 5,291,809 | 3/1994 | Fox, III et al. | 81/177.85 |
| 5,448,930 | 9/1995 | Miner | 81/57 |
| 5,450,773 | 9/1995 | Darrah | 81/57 |
| 5,568,757 | 10/1996 | Lewis | 81/177.2 |
| 5,626,062 | 5/1997 | Colvin | 81/63.2 |
| 5,647,252 | 7/1997 | Miner | 81/62 |
| 5,873,289 | 2/1999 | Jarvis | 81/177.85 |
| 5,901,620 | 5/1999 | Arnold | 81/63.2 |

*Primary Examiner*—James G. Smith
*Assistant Examiner*—David Thomas

[57] ABSTRACT

An adapter is provided to enable conventional post driven sockets to be used in conjunction with through-hole ratchets, which adapter includes a housing sized and shaped for nested engagement in the socket holding member of the through-hole ratchet, a square post which is sized for snug fitting disposition in the post hole of a conventional socket, a release actuator slidably mounted in the housing and post, a pair of lock balls movably disposed in the post in such manner that said lock balls are urged outwardly from the post and into contact with the sides of the conventional socket's post hole when the release actuator is in its fully outward position with respect to the housing and which are free to move when the actuator is in the fully depressed position, and a spring in biasing engagement with the housing and the release actuator for providing a biasing force which normally biases the release actuator to its fully outward position with respect to the housing.

7 Claims, 1 Drawing Sheet

THROUGH-HOLE QUICK RELEASE ADAPTERS

SPECIFICATION

BE IT KNOWN THAT WE, MONTIE H. MINER, a citizen of the United States and resident of the County of Madison, State of Illinois, and GARY SAUSTO, a citizen of the United States and resident of the County of St. Charles, State of Missouri, have invented certain new and useful improvements in THROUGH-HOLE QUICK RELEASE ADAPTERS of which the following is a specification, reference being made to the accompanying drawings forming a part thereof.

This invention relates to adapters for converting through-hole to conventional post drive ratchets, which adapters include releasing means for quickly and easily detaching the sockets from the posts.

BACKGROUND

This invention relates to through-hole ratchets of the type described in U.S. Pat. No. 5,450,773 and No. 5,647,252. Applicants Miner and Sausto are also joint inventors of a through-hole socket for which U.S. Pat. No. 5,448,930 has issued. It appears that through-hole ratchets will be the ratchets of the future and will eventually make post driven ratchets obsolete because of their adaptability to numerous tasks and other advantages delineated in the referenced patents. Due to the fact that there are millions of sockets constructed for use on ratchets with square drive posts in mechanic's toolboxes, a need exists for an adapter which will readily allow the use of conventional sockets in through-hole ratchets and which will further permit rapid interchange of sockets of varying dimensions.

It is the object of this invention to provide an adapter which will be readily attachable to and detachable from a through-hole ratchet, which will enable conventional post driven sockets of varying sizes to be driven by the through-hole ratchet, and which provide a quick release mechanism which will enable the operator to remove sockets with one hand and minimal effort during usage.

IN THE DRAWINGS

DESCRIPTION

Figure 2:
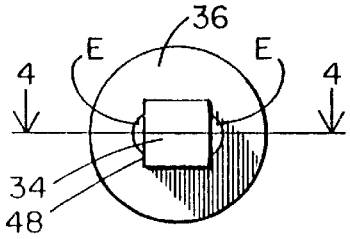
FIG. 2 is one end view thereof.
Figure 1:
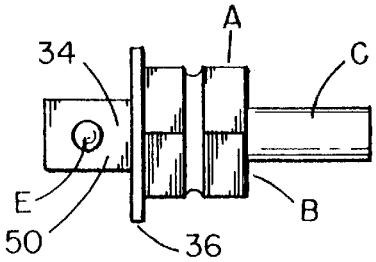
FIG. 1 is a side elevation view of a preferred embodiment of my adapter.
Figure 3:
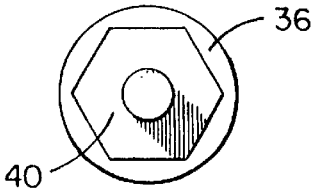
FIG. 3 is the other end view thereof.

Referring now in more detail, and by reference character to the drawings which illustrate a preferred embodiment of our invention, A designates our adapter comprising a shell B, a release actuator C, a spring D, and a pair of lock balls E.

The shell B comprises a housing 30 which includes an elongated hexagonal housing 32 at one end, an elongated square socket mounting post 34 at the other end, and an intermediate annular flange 36. The shell B is provided with a first inner bore 38 which begins at the outer end 40 of the housing 32 and extends centrally through the shell B into the post 34. The inner bore 38 includes a diametrically enlarged annular chamber 42 within the housing 32, a smaller annular chamber 44 which extends from the annular chamber 42 through most of the post 34, and an annular shoulder 46 at the junction of chambers 42 and 44. The chambers 42 and 44 are coaxial and the post 34 is provided on opposing faces 48, 50, with bores 52, 54, which extend radially outwardly from the common axis of the chambers 42, 44, the bore 52 being provided at its outer end with a diametrically reduced outer lip 74, and similarly the bore 54 is provided at its outer end with a diametrically reduced outer lip 76, the lips 74, 76 being sized for holding therein one of the lock balls E. The hexagonal housing 32 is provided exteriorly with a groove 56 which extends around the periphery of the housing 32, for purposes more fully to appear.

The release actuator C comprises an elongated shaft 60 including a central element 62 sized for movable disposition within the chamber 42, an elongated second element 64 sized for axial movement within the chamber 42 when the spring D is coiled about it, and also being sized for movable disposition in the chamber 44. At its outer end, the shaft 60 is provided with an actuator element 70. Near its inner end 80, the element 64 is provided with a peripheral groove 82 having a beveled section 84 positioned to be in alignment with the bores 52, 54, when the actuator C is pressed to its "fully in" position in the housing B. At its inner end, the element 64 is in slightly spaced separation from the end 68 of the post 34. At the junction of the elements 62, 64, there is provided a shoulder 72, for purposes presently more fully to appear. The spring D is disposed about the element 64 between the shoulders 46, 72, and the element 64 and spring D are retained in the chamber 42 by a peripheral lip 78 on the shell B at the mouth of the chamber 42. The spring D is held in the chamber 42 in such manner that the actuator C is continuously biased outwardly in which position the groove 66 does not become aligned with the bores 52, 54, until such time as the actuator C is manually pressed fully inwardly against the bias of the spring D.

Disposed in the bores 52, 54, are the lock balls E, each sized for free movement in its respective bore 52, 54. It should be here noted that in its normal position with the actuator C in its "full outward" position, the lock balls E would be urged outwardly by the inner end of the element 64.

OPERATION

Figure 5:
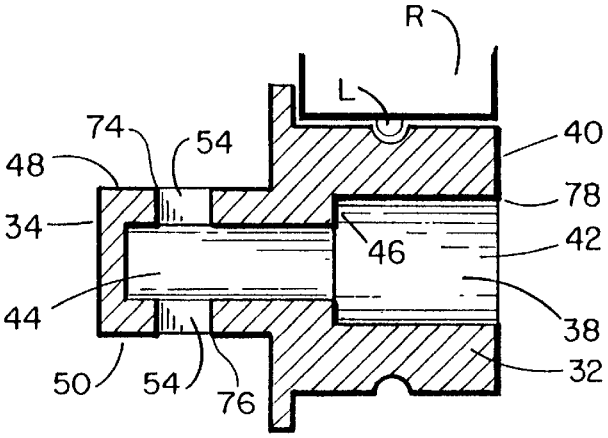
FIG. 5 is a fragmentary sectional view of the adapter shell alone taken along lines 4—4 of FIG. 2.
Figure 6:
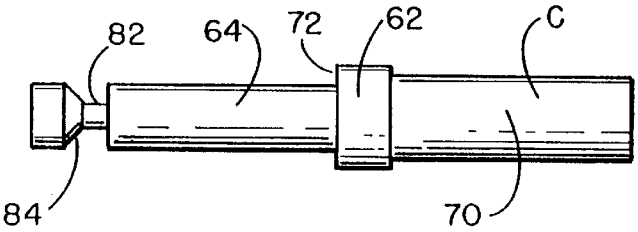
FIG. 6 is a side elevation view of the release actuator.

In use, the adapter A is secured to a through-hole ratchet R in the same manner depicted in U.S. Pat. No. 5,448,930 wherein the hexagonal shell is inserted into the Ratchet R with a latching pin L in the groove 56, shown generally in FIG. 5 of the drawings. Sockets S are mounted on the adapter A by placing the socket S onto the post 34 with the actuator C in its "fully in" position, and thereafter releasing the actuator C. The release of the actuator C causing the bias of the spriing D to move the actuator C to its "full outward" position during which movement the lock balls E are pressed outwardly against the post hole of the socket (not shown) to hold the socket on the post 34.

Figure 4:
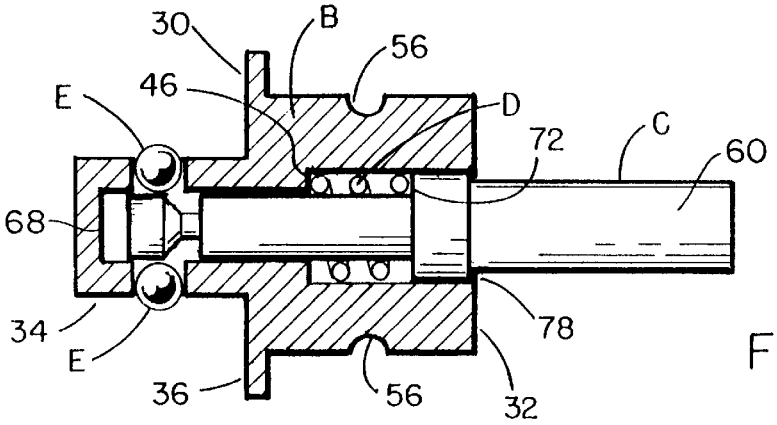
FIG. 4 is a section view along lines 4—4 of FIG. 2.

The socket is released merely by pointing the post 34 downwardly and depressing the actuator element 70 causing the lock balls E to be free to move within the bores 52, 54, releasing the retaining force provided by the lock balls E and causing the socket to fall off freely due to its own weight and the force of gravity. When the actuator C is released, the lock balls E are returned to the position shown in FIG. 4 and ready to accept a different sized socket.

It should further be noted that the post 34 is closed on its end whereby to protect the lock balls E from the accumulation of debris.

It should be apparent that changes and substitutions in the unique and novel arrangement, combination, assembly and interaction of the various parts and components shown and described herein may be made without departing from the nature and principle of our invention.

Having thus described our invention, what we claim and desire to secure by Letters Patent is shown in the drawings, described in the specification and claimed in the following claims:

We claim:

1. For use with a through-hole ratchet tool having a rotatable member adapted for holding through-hole sockets, an adapter comprising a housing including an enlarged shell and an outwardly extending post, first means for retaining the housing in the rotatable member during rotation thereof, and second means for selectively holding a post driven device on the post during rotation of the rotatable member, said second means also including means for selectively releasing the post driven device from its held engagement with the post, said second means including a pair of lock balls movably disposed in the post on opposing sides thereof, a plunger movably disposed in the housing, and holding means for forcibly urging the lock balls outwardly from the post when the plunger is in the normal position, said holding means also including means for removing the outwardly directed force from the lock balls when the plunger is depressed.

2. The adapter of claim 1 in which the housing and post are sized and shaped for rotation about the axis of rotation of the ratchet tool, the first means includes an annular notch in the housing which lies in a plane perpendicular to the axis of rotation of the tool, and the plunger and post each project axially outwardly from the rotatable member of the tool on opposing sides of said member.

3. The adapter of claim 1 in which the rotatable member is provided with a hexagonal bore, the housing includes a hexagonal segment sized for snug fitting disposition in the bore, the first means includes a peripheral notch which extends about the outer periphery of the housing in the hexagonal segment thereof, and the plunger and post each project axially outwardly from the rotatable member of the tool on opposing sides of said member.

4. The adapter of claim 1 in which the rotatable member is provided with a hexagonal bore, the housing includes a hexagonal segment sized for snug fitting disposition in the bore, the post is square in cross section and includes at least one bore on one lateral side thereof, and the second means includes at least one ball disposed in said bore and urged outwardly past the lateral face of the post by the plunger.

5. For use with a through-hole ratchet tool having a member adapted for holding through-hole sockets as said member is rotated about an axis and latching means including a latching element which projects into the area of the member where the sockets are disposed, an adapter comprising a housing sized and shaped for snug fitting disposition in the member and including an elongated recess sized and located for latching engagement with the latching element when the adapter is placed in the through-hole portion of the member, said housing including at one end an elongated square post which extends along the said axis of rotation and which is provided internally with first and second contiguous annular chambers which extend axially along the axis of rotation, said second chamber being diametrically larger than said first chamber and including a first shoulder at its juncture with said first chamber, an elongated plunger movably disposed in the first and second chambers and including a first segment sized for nested disposition in the first chamber, a second segment sized for nested disposition in the second chamber, and a third segment which projects axially outwardly from the housing, said plunger also being provided with a second annular shoulder at the juncture of its first and second segments and a diametrically reduced flared section near the end of the first segment, said post being provided on opposing faces with access bores in each of which is movably disposed a lock ball, said bores and balls being sized and located in such manner that when the plunger is depressed fully inward the lock balls may move freely within their respective access bores, and when the plunger is fully outward, said lock balls are urged radially outwardly in their respective access bores by the flared section, first means for retaining the lock balls in their respective access bores, second means for retaining the first and second segments of the plunger in the first and second chambers of the housing, and spring means disposed in the housing between the first and second shoulders for urging the third segment of the plunger outwardly and simultaneously urging the lock balls radially outwardly from the axis of rotation.

6. For use with a through-hole ratchet tool having a yoke which is rotationally movable about an axis and includes a hexagonal aperture which is perpendicular to said axis, an adapter comprising a housing shaped hexagonally at one end for snug fitting disposition in the hexagonal aperture, said housing including at its other end an elongated square post which extends along the said rotational axis and which is provided internally with a first annular chamber, said housing also including an axially extending second annular chamber which is diametrically larger and coaxial with said first chamber and which includes a first annular shoulder at its juncture with said first chamber, an elongated plunger movably disposed in the first and second chambers and including a first segment sized for nested disposition in the first chamber, a second segment sized for nested disposition in the second chamber, and a third segment which projects axially outwardly from the housing, said plunger also being provided with a second annular shoulder at the juncture of its first and second segments and a diametrically reduced flared section near the end of the first segment, said post being provided on opposing faces with access bores in each of which is movably disposed a lock ball, said bores and balls being sized and located in such manner that when the plunger is depressed fully inward the lock balls may move freely within their respective access bores, and when the plunger is fully outward, said lock balls are urged radially outwardly in their respective access bores by the flared section, first means for retaining the lock balls in their respective access bores, second means for retaining the first and second segments of the plunger in the first and second chambers of the housing, spring means disposed in the housing between the first and second shoulders for urging the third segment of the plunger outwardly and simultaneously urging the lock balls radially outwardly from the axis of rotation, and means for detachably latching said housing to said yoke.

7. The device of claim 6 where the post is a closed end post.

* * * * *